US005538416A

United States Patent [19]

Peterson et al.

[11] Patent Number: 5,538,416

[45] Date of Patent: Jul. 23, 1996

[54] GAS BURNER CONTROLLER WITH MAIN VALVE DELAY AFTER PILOT FLAME LIGHTOFF

[75] Inventors: Scott M. Peterson, Eden Prairie; Edward L. Schwarz, Minneapolis, both of Minn.

[73] Assignee: Honeywell Inc., Mnneapolis, Minn.

[21] Appl. No.: 402,682

[22] Filed: Feb. 27, 1995

[51] Int. Cl.[6] ..... F23Q 9/08

[52] U.S. Cl. ..... 431/46; 431/59; 431/51

[58] Field of Search ..... 431/25, 46, 45, 431/59, 51

[56] References Cited

U.S. PATENT DOCUMENTS 3,594,107 7/1971 Wilson .
3,915,149 10/1975 Kemp .
4,457,692 7/1984 Erdman ..... 431/46
4,789,329 12/1988 Bohan, Jr. et al. .
5,035,607 7/1991 Peterson .
5,439,374 8/1995 Jamieson ..... 431/25

*Primary Examiner*—Carroll B. Dority
*Attorney, Agent, or Firm*—Edward L. Schwartz

[57] ABSTRACT

A controller for a gas burner system compensates for the tendency of a flame rod sensor in the burner system to on occasion provide a spike in its signal on first lightoff of a pilot flame, by delaying the signal which causes opening of the burner system's main burner valve until the sensor signal has had a chance to reach to its normal level indicative of the presence of the pilot flame. This time varies from about 5 to 30 seconds.

15 Claims, 6 Drawing Sheets

GAS BURNER CONTROLLER WITH MAIN VALVE DELAY AFTER PILOT FLAME LIGHTOFF

BACKGROUND OF THE INVENTION

Typical gas burner systems include a controller which provides the signals for operating the various elements of the burner system. In a typical such burner system, these elements include a combined pilot/main gas valve receiving gas from an external source and a main only gas valve receiving its flow of gas from the pilot/main gas valve. A pilot burner element receives gas directly from the pilot/main gas valve, and a main burner element receives fuel from the main valve. The burner elements are mounted in a combustion chamber where the gas is burned. An igniter for initiating combustion of the fuel is located directly in the path of gas flow from the pilot burner element.

There are two types of igniters in general use at the present time. One is of the type which generates a spark to cause the ignition. The other type passes current through a resistive element sufficient to heat it to a temperature capable of igniting the gas, and are frequently referred to as hot surface igniters. For reasons of durability and reliability, the hot surface igniter is now usually preferred for most gas burners.

The typical sequence of operation by the controller when heat from such a burner is desired, is first to provide a signal to the igniter which activates it, generating heat and then to provide a signal to the pilot/main valve causing it to open. The fuel flowing to the pilot burner element is ignited by the igniter. As soon as the pilot flame has been established, a sensor detects its presence and provides a flame present signal to the controller. The controller then provides a signal which opens the main valve. The main valve allow gas to flow to the main burner where it is ignited by the flame from the pilot valve. Once the main burner flame is established, it is of course self-sustaining during normal operation. The sensor is important because absence of the flame signal is used by the controller to abort opening of the main valve where the pilot flame has not been established, and to allow the controller to immediately close the main valve if the flame signal vanishes during normal operation. It goes without saying that holding the main and main/pilot valves open when flame is not present creates a very perilous situation. This type of burner controller is described in greater detail in my U.S. Pat. No. 5,035,607 which is assigned to the assignee of this application.

There are a number of different types of flame sensors which can be used in a gas burner installation. One which is used extensively in modern burner installations because it is relatively inexpensive and at the same time extremely reliable is the so-called flame rod sensor. Such a flame sensor is disclosed in the above-mentioned '607 patent. A flame rod sensor relies on the differing areas of a flame rod and the metal pilot burner element to form from them an electrical device which employs the ionized molecules of the flame when present to act as carriers for a current resulting from an AC voltage applied between them. The electrical device thus formed has an impedance from the flame rod to the burner element which is markedly lower than the impedance in the other direction and thus forms a rectifier of sorts. The rectifier connection between the igniter and the burner appears only when flame is present. A simple amplifier with a filtered input can detect the presence of the direct current component of current flow between the flame rod and the burner when flame is present. If this flame rod current flow is at least a preselected flame present level, then flame can be assumed to be present.

Recently, a peculiarity in the operation of flame rod sensors has been noted. On occasion during startup, particularly for flame rods which have been in service for a significant portion of their lifetime, the flame rod signal current will exceed the flame present level for a short period of time, perhaps a second or so, after the pilot flame first appears and then fall for a longer period of time to below the flame present level, even though the pilot flame is fully established. We call this phenomenon the flame rod signal anomaly. The interval immediately following presence of pilot flame where the flame rod signal is above the flame present level and before the flame signal level falls below the flame present level, we call the first anomaly interval. The interval of low flame rod signal current while a bona fide pilot flame exists and which follows a first anomaly interval, is called the second anomaly interval.

The first anomaly interval is typically a second or so long as previously mentioned, and the second anomaly interval may be as long as ten or fifteen seconds. The first anomaly interval is typically long enough to allow the controller to begin the main valve opening phase of the startup sequence. Part way into the main valve opening phase if the anomaly arises, the controller interprets the low flame rod signal current of the second anomaly interval as a pilot flame out condition, and responds by terminating the main valve opening phase and attempting to restart the pilot flame. After the second anomaly interval ends, the flame rod begins to continuously produce a flame rod signal level above the flame present level. The main valve opening phase again starts and proceeds normally to produce normal operation. The anomaly interval does not result in hazardous operation, but it does cause additional actuations of the main and pilot valves and operation of the igniter which may lead to premature failure of these components. The anomaly also creates the impression for someone who is close enough to hear the additional actuations of the valves that the system is operating improperly. Although this is not true, the impression thus created respecting the manufacturer may be adverse.

At the present time we do not know what is the cause of the flame rod signal anomaly, nor do we know how to avoid its occurrence. Nevertheless, it would be advantageous to at least avoid the effects of this anomaly on the operation of the burner system, and thus improve the user's impression of the system's performance.

BRIEF DESCRIPTION OF THE INVENTION

We have designed an improvement for a burner controller which avoids the undesired effects on the system operation of the flame rod signal anomaly described above, although this improvement does not prevent its occurrence. A burner controller incorporating my invention is intended for use with a burner system having a pilot burner element receiving fuel whose flow is controlled by a pilot fuel valve, a main burner element receiving fuel whose flow is controlled by a main fuel valve, an igniter, and a flame rod type of flame sensor. The pilot fuel valve opens responsive to a pilot valve signal to provide flow of fuel to the pilot burner element. The main fuel valve opens responsive to a main valve signal to provide flow of fuel to the main burner element. The flame rod flame sensor provides a flame rod signal having a level above a predetermined flame present level during normal operation responsive to combustion of fuel flowing to either of the burner elements. The igniter is activated by the controller as soon as fuel starts flowing to the pilot burner element to ignite the pilot burner fuel. The controller including valve control means receiving the flame rod signal for supplying the main valve signal responsive to the flame rod signal having current flow above the predetermined level.

The improvement comprises in the valve control means, a level sensor and a main valve control circuit means. The level sensor receives the flame rod signal and provides a flame indicator signal having a first level while the flame rod signal exceeds the flame present level and a second level otherwise. The main valve control circuit means receives the flame indicator signal, including the first and second anomaly intervals. The main valve control circuit means detects the end of the second anomaly interval, and in response provides a main valve signal thereafter which causes the main valve to open.

In our preferred embodiment, the main valve control circuit means comprises a delay element receiving the flame indicator signal and providing a delayed flame indicator signal in which each second level to first level transition of the flame indicator signal (which indicates appearance of flame) is delayed for a preselected delay interval which should be at least longer than most of the first anomaly intervals. Logic means are provided which receive the flame indicator signal and the delayed flame indicator signal, for providing the main valve signal responsive to both the flame indicator signal and the delayed flame indicator signal having their first levels. In this way, the initial opening of the main valve is almost always delayed until after the second anomaly interval has expired, and therefore, opening of the valve for the most part occurs only once for each startup sequence.

It is also possible to implement the invention as part of a microcontroller and its software or firmware. In such an embodiment, the microcontroller functions as both the delay element and the logic means. The microcontroller receives the flame indicator signal and supplies the main valve signal at the appropriate time. Such a microcontroller has a memory in which is recorded a plurality of instructions and an instruction processor receiving instructions from the memory. For purposes of implementing this embodiment of the invention, the memory and instruction processor in combination comprising first through fourth instruction means respectively existing during execution of first through fourth groups of instructions. The logic means comprises the first and second instruction means and the delay element comprises the third instruction means. The first and second instruction means respectively transfer instruction execution to the third and fourth groups of instructions responsive to a transition from the second to the first level in the flame indicator signal. The third instruction means transfers execution of instructions to the second group of instructions after delaying for the preselected delay interval. The fourth instruction means comprises means for issuing the main valve signal.

DESCRIPTION OF THE PREFERRED EMBODIMENTS

Figure 6:
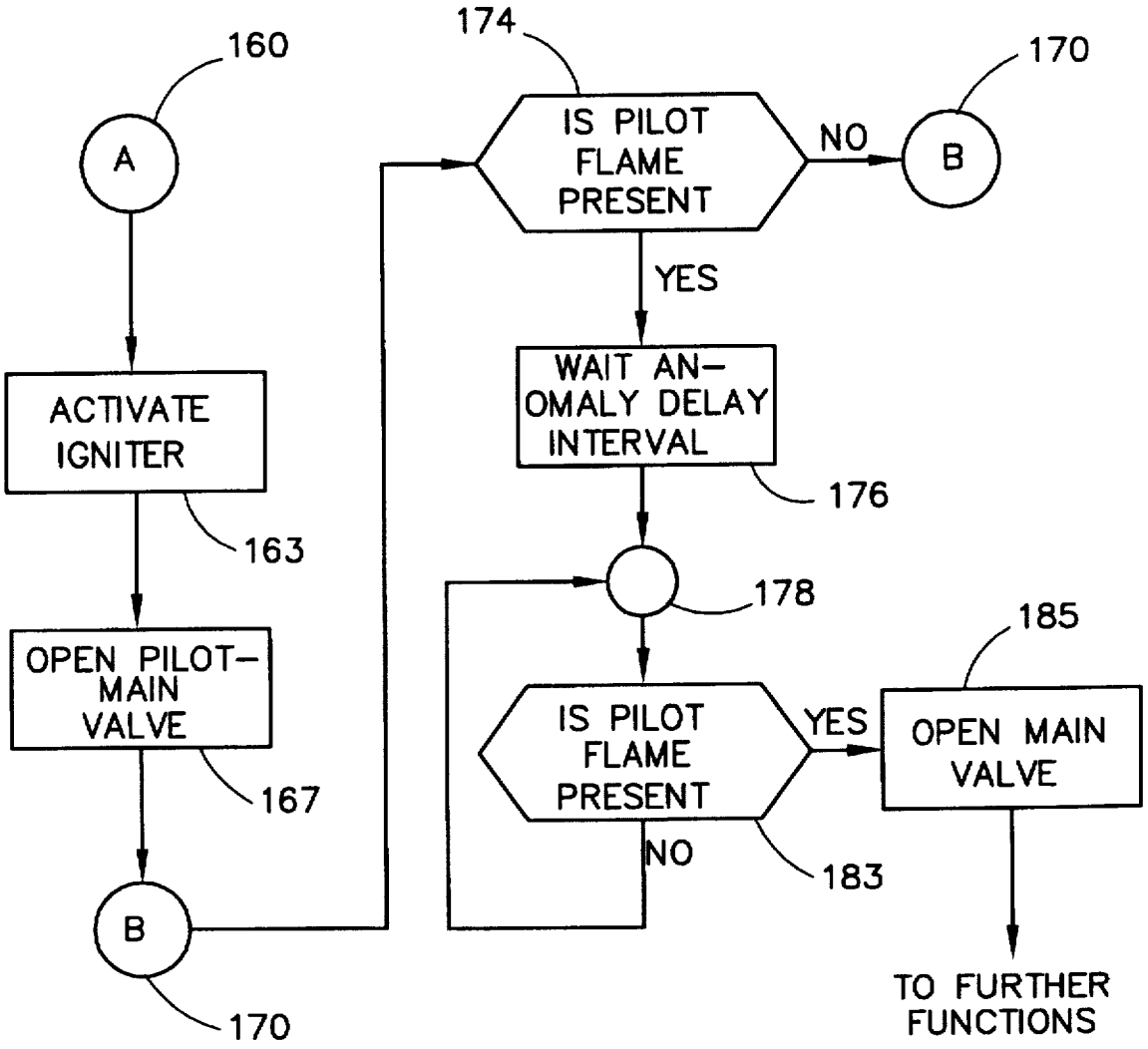
FIG. 6 is a flow chart for software which may be executed by the microprocessor in implementing the invention.

As with the invention forming the subject of the '607 patent mentioned above, this invention can be implemented as either hardware with individual circuit elements as shown in FIGS. 1–4, or as software as shown in FIGS. 6 and 7.

Figure 1:
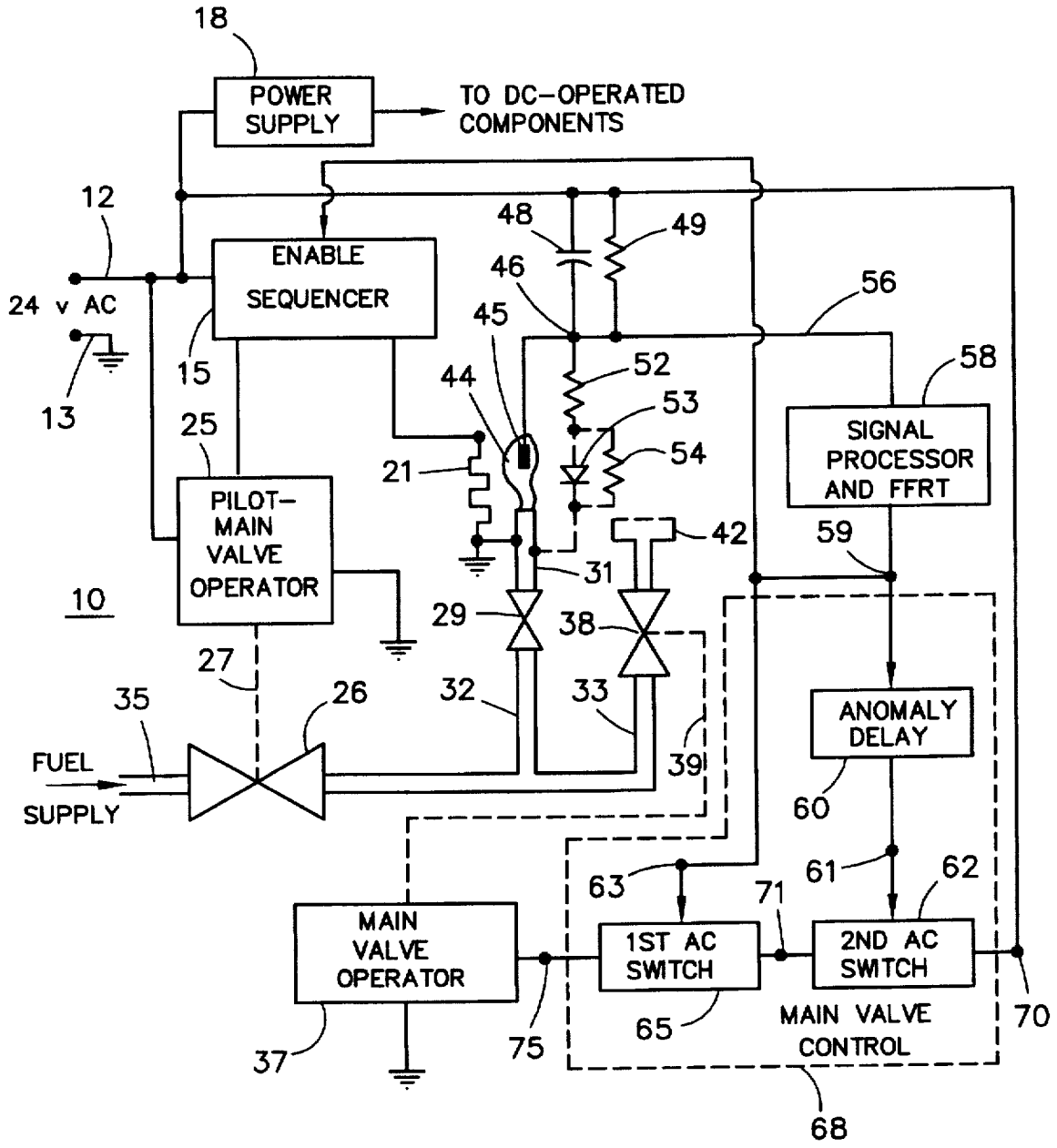
FIG. 1 is a block diagram of a burner system which includes simplified hardware for implementing the invention.

Turning first to the generalized hardware embodiment of FIG. 1, therein is shown a burner system 10. 24v. AC power is applied between power terminal 12 and ground terminal 13, typically by a step-down transformer. In the typical arrangement, power is not applied to terminal 13 until there is a requirement for the burner system 10 to supply heat. Supply of AC power to terminal 12 is usually controlled by the operation of a thermostat (not shown). Once AC power is supplied to terminal 12, a power supply 18 receives that AC power from terminal 12 and supplies suitable DC voltage for operating the various electronic elements of system 10 requiring DC power.

A sequencer 15 also receives AC power from terminal 12 and supplies AC power to the various components of system 10 which are operated by AC power. A pilot-main valve 26 controls flow of fuel from pipe 35 to a pilot burner supply pipe 32 and a main burner supply pipe 33. Fuel carried by pipe 32 passes through a pressure reduction valve 29 to a pilot burner 31. Fuel carried by pipe 33 flows through a main valve 38 to a main burner 42. The setting of pilot-main valve 26 is controlled by a pilot-main valve operator 25 acting through a mechanical linkage 27. The setting of main valve 38 is controlled by a main valve operator 37 acting through a mechanical linkage 39. Each of the valve operators 25 and 37 typically comprises an electrically-operated solenoid or actuator receiving AC power to be internally rectified, although valve operators powered directly from a DC power supply such as power supply 18 are often also used. There is also a hot surface igniter 21 closely juxtaposed to pilot burner element 31 so that when receiving AC power from sequencer 15, will ignite fuel flowing from pilot burner 31. Although not totally clear from FIG. 1, pilot burner 31 in an actual burner system 10 is closely juxtaposed to main burner 42, so that presence of a pilot flame shown at 44 absolutely guarantees that fuel flowing from main burner 42 will be ignited.

Sequencer 15 supplies and removes the AC power to valve operators 25 and 37 at the appropriate times after power is first applied to terminal 12 during a call for heat. In the usual situation after power is supplied to terminal 12, igniter 21 is powered, and after its operation has been assured, power is supplied to pilot-main valve operator 25, thereby opening valve 26. Fuel flows through valve 26 to pilot burner element 31 and is ignited by igniter 21.

Flame shown at 44 must be present at pilot burner 31 before the sequence of operations can continue. Indeed in these intermittent pilot systems, the sole requirement for opening and holding open main valve 38 is pressure of pilot flame. A flame rod sensor 45 is located in physical proximity to pilot burner element 31. A capacitor 48 connects flame rod 45 to power terminal 12, and resistor 49 is connected in parallel with capacitor 48. After a flame is established at burner 21, the flame rod sensor 45 begins to function as the anode element of an imperfect rectifier element, with the grounded pilot burner element 31 serving as the cathode of this rectifier. It is convenient to symbolize the equivalent circuit formed when flame is present at the pilot burner 31, as comprising an equivalent diode 53 having a cathode element electrically connected to pilot burner element 31, an equivalent resistor 52 in series connection between flame rod 45 and the anode of the diode 53, and an equivalent resistor 54 in parallel connection across diode 53. The equivalent status of these elements is symbolized by the dotted line circuit connections between them, and flame rod 45 and pilot burner element 31.

When these equivalent circuit elements are present because flame is present, current flows through resistor 52, and diode 53 and resistor 54, causing a charge to accumulate on capacitor 48. This charge creates a flame rod signal comprising a DC current which flows from terminal 46 to a signal processor 58. Although the flame rod signal current is small, in the fraction of a microampere range, signal processor 58 can compare it with a threshold level to detect the presence of flame at the pilot burner 31 with extremely high reliability. While the flame rod signal current is above the threshold level, signal processor 58 provides a flame indicator signal at terminal 59 having a first level. Should pilot flame 44 disappear, resistor 49 discharges capacitor 48 within a second or so, causing the flame rod signal current to fall below the threshold level. Signal processor 58 provides a flame indicator signal at terminal 59 having a second level responsive to the flame rod signal current level below the threshold level. Signal processor 58 includes a so-called flame failure response timer (FFRT) function which compensates for short-lived excursions of the flame rod signal current to below the threshold level, by holding the flame indicator signal at its first level during these excursions. To this point in the discussion, the structure and operation of the burner system is conventional.

Figure 2:
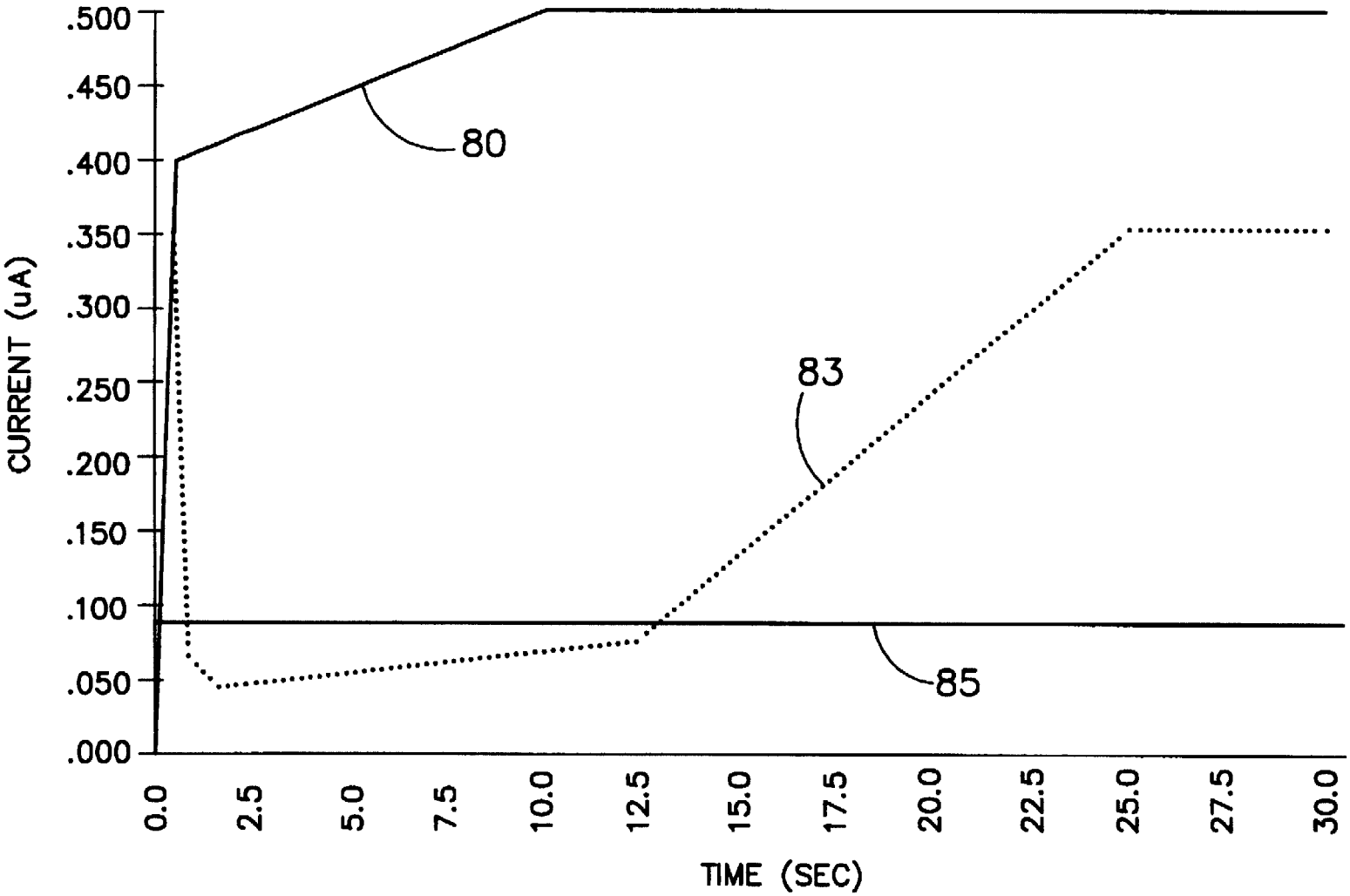
FIG. 2 is a graph showing waveforms associated with the operation of the invention.

It is next helpful to consider FIG. 2 which shows for a particular type of flame rod 45 and main burner 42 geometry, representative waveforms of the flame rod signal current on path 56 versus time after pilot burner lightoff. Waveforms 80 and 83 show flame rod current for new and certain old flame rods 45 respectively. Current threshold 85 represents the threshold current level which experience shows for the type of flame rod involved will indicate the presence of flame to a virtual certainty. The interval from 0 to approximately 1 sec. in waveform 83 is defined as the first anomaly interval, during which the flame rod signal current is above threshold 85. The interval from approximately 1 sec. to 12 sec. for waveform 83 represents the flame rod signal current's second anomaly interval. This second anomaly interval is followed by an uninterrupted period of normal operation while flame is present where the flame rod current level is greater than threshold 85. We have found that a typical first anomaly interval is in the range of one-half to two seconds.

Signal processor 58 provides the flame indicator signal at terminal 59 to a main valve control circuit 68. Control circuit 68 is shown in FIG. 1 as having an anomaly delay timer 60 receiving as an input the flame indicator signal at terminal 59. The output of delay timer 60 is a delayed flame indicator signal which for explanatory purposes here may be considered to mimic the flame indicator signal, but delayed with respect thereto by an anomaly delay interval longer than the expected duration of typical first anomaly intervals. For common flame rod 45 and pilot burner 31 geometries, we have found that appropriate values for the anomaly delay interval are usually on the order of one to two seconds. The delayed flame indicator signal at terminal 61 has transitions from first to second levels delayed with respect to the corresponding change in the flame indicator signal by the anomaly delay interval. The same relationship exists of course for the delayed flame indicator signal, for transitions in the flame indicator signal from its second to its first level.

The flame indicator signal at terminal 59 is applied directly to the control terminal 63 of a first AC switch 65. The delayed flame indicator signal provided by the delay timer 60 is applied to a second AC switch 62. First switch 65 has input and output power terminals 71 and 75 respectively. First switch 65 closes so as to conduct AC power between power terminal 71 and 75 responsive to the first level of the flame indicator signal at terminal 63, and does not conduct between power terminals 71 and 75 responsive to the second level of the flame indicator signal. Second switch 62 operates in a manner similar to first switch 65, closing to conduct between its power terminals 70 and 71 responsive to the first level of the delayed flame indicator signal at terminal 61, and opening responsive to the second level of the delayed flame indicator signal. The power terminals of switches 65 and 62 are connected in series so that the input power terminal of first AC switch 65 and the output power terminal of second AC switch 62 are the same terminal 71. The delay interval of anomaly delay element 60 is preset to exceed the typical length of the first anomaly interval. Second AC switch 62 conducts responsive to the first level of the delayed flame indicator signal and does not conduct responsive to the second level of the delayed flame indicator signal. The delayed flame indicator signal at terminal 61 mimics the flame indicator signal at terminal 59, so that the conduction status of second AC switch 62 is always the conduction status of first AC switch at the time earlier by the delay interval of delay element 60.

AC power from terminal 12 is applied to the input power terminal 70 of second AC switch 62. When both first AC switch 65 and second AC switch 62 conduct AC power, then power is supplied to main valve operator 37 at terminal 75, causing valve operator 37 to actuate linkage 39 to open valve 38. One can see that once the flame rod signal current exceeds the threshold level and the signal processor 58 has provided a flame indicator signal having its first level, first switch 65 closes. Then after the anomaly delay interval has expired, the second switch 62 closes, allowing current from power terminal 12 to flow to main valve operator 37. In response to this flow of current, main valve operator opens main valve 38 and fuel flows to main burner 42 from supply pipe 33. This fuel is ignited by the pilot burner 31 flame, and normal main burner 42 operation commences.

If at some later time flame is lost at burner 31, the flame rod signal on path 56 shortly thereafter falls to below the threshold level and the signal processor 58 immediately changes the level of the flame indicator signal at terminal 59 to its second level. In response to this flame indicator signal level, first switch 65 opens and power to main valve operator 37 is lost. Valve 38 then closes, and flow of fuel to burner 42 is halted, preventing the dangerous condition of fuel flow to main burner 42 where no flame is present at pilot burner 31. At this time in a commercial burner system 10, it is necessary to restart the system. To symbolize this function, the flame indicator signal is supplied to an ENABLE input of sequencer 15. In response to a change in the flame indicator signal from its first to its second level, sequencer 15 begins the startup procedure by applying power to the igniter 21. Operators 25 and 37 are designed such that when power is removed from path 12 valves 26 and 38 automatically close.

Figure 3:
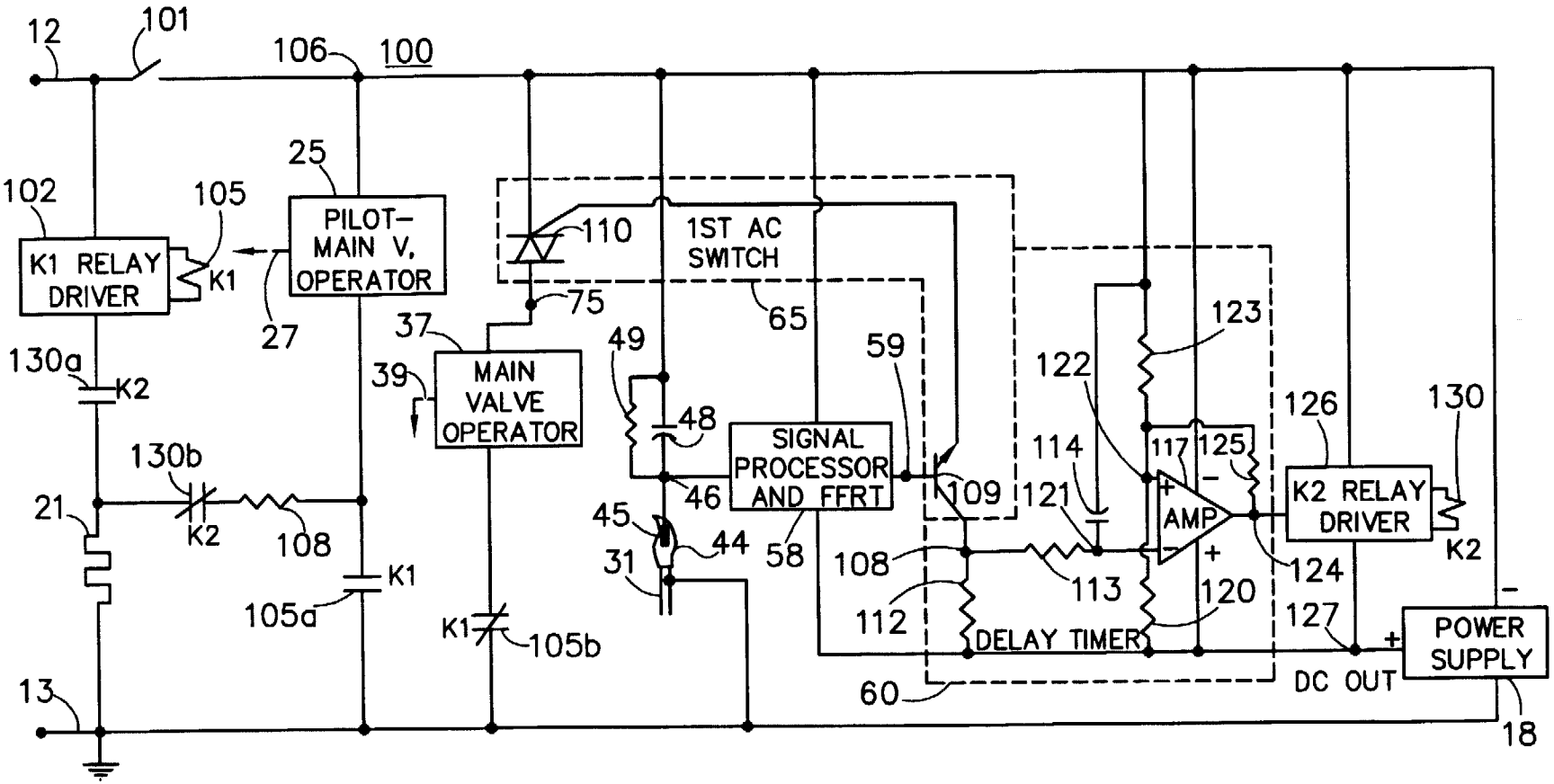
FIG. 3 is a detailed circuit and block diagram of hardware implementing the preferred embodiment of the invention.

The arrangement of the elements of main valve control circuit 68 shown in FIG. 1 reflects the actual structure of the preferred embodiment shown in FIG. 3. However, there are several variants which are to all intents and purposes indistinguishable from that shown in FIG. 1. For example, if absence of the first level of the flame indicator or delayed flame indicator signal corresponds to the second level of each, then first switch 65 might be chosen to be of the type for switching the delayed flame indicator signal rather than power for main valve operator 37. Then first switch 65 can be connected to switch the delayed flame indicator signal supplied by delay timer 60 to second switch 62. Switch 62 controls flow of power from terminal 70 to operator 37 in this variant. In another variant, second switch 62 can gate the flame indicator signal controlling first switch 65, and terminal 71 is directly coupled to power terminal 12. An advantage of these variant configurations is that only one switch is needed for controlling flow of the larger current required by operator 37.

FIG. 3 is a detailed circuit block diagram of the preferred embodiment for the subject invention. The circuit of FIG. 3 enlarges on and fills in details of the more generalized circuit of FIG. 1. However, the circuit of FIG. 3 has additional capabilities as compared to the simplified circuit of FIG. 1 and also takes advantage of dual functions available from some of the components by their proper selection. Because of these improvements, the individual functions are not as neatly compartmentalized in FIG. 3 as in FIG. 1.

FIG. 3 shows a modified burner system 100 from which for convenience are omitted some of the combustion components shown in the system of FIG. 1. In the circuit forming a part of FIG. 3, a thermostat 101 switches AC power from power terminal 12 to AC power bus 106. When thermostat 101 closes, AC power on bus 106 initiates a startup operating sequence similar to that controlled by sequencer 15 in FIG. 1. Power supply 18 receives the AC power on bus 106 and converts this AC power to a DC voltage supplied on DC power bus 127 for operating a number of the electrical components of system 100. In this circuit, DC bus 127 serves as the positive (+) DC power terminal and bus 106 serves as the negative (–) DC power terminal. This arrangement of the AC power source and DC power supply 18 power terminals, efficiently accommodates AC power for the flame rod 45, the flame rod 45 signal itself, and conversion of the AC power into the DC power required by the various electronic components. DC power bus 127 is referenced to AC power bus 106 so relative to ground (power terminal 13), the voltage of DC bus 127 appears to be AC. However, a simple half wave rectifier type of power supply 18 connected to receive the AC voltage potential between busses 106 and 13, provides an AC voltage on bus 127 which is exactly in phase with the AC waveform of bus 106 and spaced from it by the DC voltage potential provided by power supply 18. Therefore, an effective DC voltage is provided across the busses 106 and 127. If one applies to terminals 12 and 13 the 24 VAC provided by a standard step-down transformer used to power HVAC equipment, power supply 18 creates an unregulated DC voltage potential between busses 106 and 127 of about 30v.

Among the capabilities in the circuit of FIG. 3 not explicitly shown in the circuit of FIG. 1 is a safe start delay function causing in the startup sequence, a delay after thermostat 101 closes and before the pilot valve is opened and power is applied to igniter 21. This safe start delay is intended to prevent certain malfunctions such as a leaky pilot-main valve 26 from causing a potentially unsafe condition from occurring. To implement the safe start delay, as soon as the DC power supply 18 begins to supply DC voltage across – and + DC power busses 106 and 127, this DC voltage begins to charge an initially uncharged timer capacitor 114 through the series circuit of resistors 112 and 113. As capacitor 114 charges, the voltage across it and available at terminal 121 becomes more positive.

The DC power from – and + DC busses 106 and 127 is also provided to the – and + power terminals of a high gain amplifier 117 as shown. By high gain is meant that amplifier 117 provides an output voltage at output terminal 124 whose response is extremely nonlinear outside of a narrow voltage differential between its + and – signal terminal. Amplifier 117 is connected at its – signal terminal, which is the same as terminal 121, to receive the capacitor 114 voltage. A voltage divider comprising resistors 120 and 123 provides a reference voltage at the + signal terminal of amplifier 117, which is the same as terminal 122. The reference voltage at signal terminal 122 has hysteresis incorporated in it by the action of a feedback resistor 125 which is connected from the output terminal 124 of amplifier 117 to its + input terminal 122. Resistor 125 may be several times the size of the larger of resistors 120 and 123 so as to cause a small change in the voltage at terminal 124 as the output signal voltage at terminal 124 changes. While amplifier 117 may comprise a single component or module such as an operational amplifier, in a commercial product incorporating this invention amplifier 117 is implemented as a simple discrete component circuit for reasons of cost.

Resistors 112 and 113 and capacitor 114 are sized to allow the capacitor 114 voltage available at terminal 121 and created by the increasing charge on capacitor 114 to rise above the voltage at terminal 122 a few seconds after full DC voltage appears across buses 106 and 127. The interval between the initial closing of thermostat 101 and the time when the voltage across capacitor 114 at terminal 121 rises above the voltage at terminal 122 defines the safe start delay.

While the voltage at the – terminal 121 of amplifier 117 is more positive than the voltage at the + terminal 122, the high gain of amplifier 117 causes its output voltage on path 124 to be close to the (nominally zero) voltage at – power terminal (bus 127). If the voltage at the – input terminal 121 of operational amplifier 117 is more negative than the voltage at the + input terminal 122, the output voltage of operational amplifier 117 on path 124 is held close to the (nominally 30v. unregulated) voltage at power bus 106. Feedback resistor 125 creates hysteresis in this amplifier by pulling the reference voltage at + input terminal 122 slightly more positive or negative when the voltage at – input terminal 121 becomes respectively more negative or positive than the voltage at + input terminal 122. This hysteresis prevents amplifier 117 from reaching any output voltage other than these two states.

The amplifier 117 output voltage at terminal 124 is applied to the input terminal of a K2 relay driver 126 to control the state of K2 relay 130. K2 relay driver 126 energizes a K2 relay winding 130 when the voltage on path 124 is close to the voltage of + DC power bus 127. When the voltage on terminal 124 reaches its more negative value near 0v., K2 relay driver 126 does not energize K2 relay winding 130.

The K2 relay has two contact pairs **130*a* and 130*b*. Contact pair 130*a* is normally open (NO) as symbolized by the absence of a diagonal line through it. "Normally open" means that the contacts do not conduct when the winding of the associated relay is not energized, and do conduct when the winding is energized. Contacts 130*a* are connected in series with a K1 relay driver 102 and the igniter 21 across AC power terminals 12 and 13. Contact pair 130***a* shares a pole with the normally closed (NC) K2 relay contact pair 130*b*, and hence are shown as directly connected to each other. The K1 relay driver 102 energizes the K1 relay winding 105 when the K2 relay contacts 130*a* are closed so that current can flow through both igniter 21 and K1 relay driver 102. The impedance of the K1 relay driver 102 is sufficiently low to permit igniter 21 to operate normally when these two elements are in series connection. Further, since the K1 relay driver 102 is in series with igniter 21, K1 relay winding 105 can be energized only if igniter 21 is conducting, an arrangement which provides assurance that pilot-main valve driver 25 opens only if igniter 21 is operating properly. It is necessary to place the series-connected igniter 21 and K1 relay driver 102 directly between power terminals 12 and 13 because the current-carrying capacity of a typical thermostat 101 is not adequate for the current required by igniter 21.

The K1 relay has a NO contact pair 105*a* which controls current flow to the pilot-main valve operator 25. The NO contact pair 105*a* shares a contact with the K1 NC contact pair 105*b*, which controls flow of current to main valve operator 37. K1 NC contacts 105*b* form a part of the second AC switch 62 in FIG. 1. Valve operators 25 and 37 have mechanical linkages 27 and 39 respectively which are connected as shown in FIG. 1 to control the state of fuel valves 26 and 38. When the K1 contact pair 105*a* closes, the pilot-main valve 26 opens, and fuel flows to the pilot burner 31 as explained in connection with FIG. 1. As soon as a pilot flame 44 appears, current begins to flow from the flame rod 45 to pilot burner 31, causing capacitor 48 to charge and a flame rod current to flow from terminal 46 to signal processor 58.

Signal processor 58 provides an output signal voltage at terminal 59 to transistor 109. When the flame rod signal current is below the threshold level, signal processor 58 holds the output signal voltage at terminal 59 close to the voltage at – DC bus 106, and transistor 109 does not conduct. When flame 44 is sensed by flame rod 45, then current flows to signal processor 58, which causes the voltage at terminal 59 to become more positive, that is, closer to the voltage at + DC bus 127. The more positive voltage at terminal 59 causes transistor 109 to conduct, drawing current from + DC bus 127 through resistor 112 and from capacitor 114 through resistor 113 and allowing this current to flow to the gate terminal of a triac 110. Triac 110 controls flow of current to main valve operator 37. The current flowing to the gate of triac 110 conditions triac 110 to allow current flow whenever an AC voltage potential appears between terminals 75 and 106. Triac 110 and transistor 109 cooperate to function as the first AC switch 65 shown in FIG. 1 controlling flow of current to operator 37.

The current flow through transistor 109 also shifts the voltage at terminal 108 closer to the voltage of – DC bus 106, causing capacitor 114 to discharge over a period of a second or two. The voltage at terminal 121 thus becomes less positive, falling closer to the voltage of –DC bus 106. As capacitor 114 discharges, a point will be reached where the voltage at terminal 121 becomes less positive than the voltage at terminal 122. At this point, the operational amplifier 117 output signal voltage on path 124 changes to again become close to the voltage on + DC bus 106. The less positive voltage on path 124 causes K2 relay driver 126 to deenergize the K2 relay winding 130. The deenergized K2 relay winding 130 causes the K2 relay contact pairs 130*a* and 130*b* to each change conduction states, with the K2 NO contact pair 130*a* no longer conducting, and the K2 NC contact pair 130*b* now conducting.

When the K2 NO contact pair 130*a* again opens, power flow to K1 relay driver 102 ceases, and the K1 relay winding 105 becomes deenergized. The deenergizing of K1 relay winding 105 causes the K1 NO contact pair 105*a* to again become open, and the K1 NC contact pair 105*b* to close. When the K1 NC contact pair closes, then a completed series circuit comprising triac 110, main valve operator 37 and K1 NC contact pair 105*b* exists. Current then starts flowing through main valve operator 37, and main valve 38 (FIG. 1) is opened by the mechanical linkage 39. K2 NC contact pair 130*b* forms a series circuit with igniter 21, a resistor 108, and pilot-main valve operator 25 between bus 106 and ground terminal 13. AC power thus flows to pilot-main valve operator 25. The value of resistor 108 is chosen so that its resistance plus that of igniter 21 is small enough to hold pilot-main valve 26 open if already open, but large enough so that if pilot-main valve operator 25 has not already opened pilot-main valve 26, the current flow is insufficient to open valve 26.

The reader will see that there is a delay from the time flame is detected and transistor 109 starts to conduct until capacitor 114 has discharged sufficiently to cause the K1 NC contact pair 105*b* to close. This delay is the anomaly delay interval, and depends on the values of capacitor 114 and resistor 113. These component values should be chosen to make this anomaly delay interval longer than the first anomaly interval. By specifying the values of capacitor 114 and resistor 113 to hold the voltage at terminal 121 below the voltage at terminal 122 for longer than the first anomaly interval, main valve operator 37 will not be energized until after the first anomaly interval has expired. If flame current at terminal 59 falls to below a level indicating presence of a flame 44 during the anomaly delay interval, transistor 109 again stops conducting. Triac 110 loses its gate current and also stops conducting, and capacitor 114 again begins charging because terminal 108 voltage has shifted closer to the voltage of + DC bus 127. Therefore, the amplifier 117 output signal cannot change to cause K2 relay driver 126 to deenergize K2 relay winding 130 until transistor 109 has been nonconductive long enough to discharge capacitor 114 to the point that amplifier 117 has disabled K2 relay driver 126.

One can see then, that upon first closing thermostat 101, the time required to charge capacitor 114 to a voltage at terminal 121 which causes the K1 relay winding 105 to be energized provides a safe start delay interval. After the safe start delay interval has expired, then the igniter 21 and the pilot-main valve operator 25 are energized. After flame has been detected by flame rod 45 and signal processor 58, the time required to discharge capacitor 114 so that voltage at terminal 121 is less positive than the voltage at terminal 122 forms the anomaly delay interval for opening the main valve 38.

Figure 4:
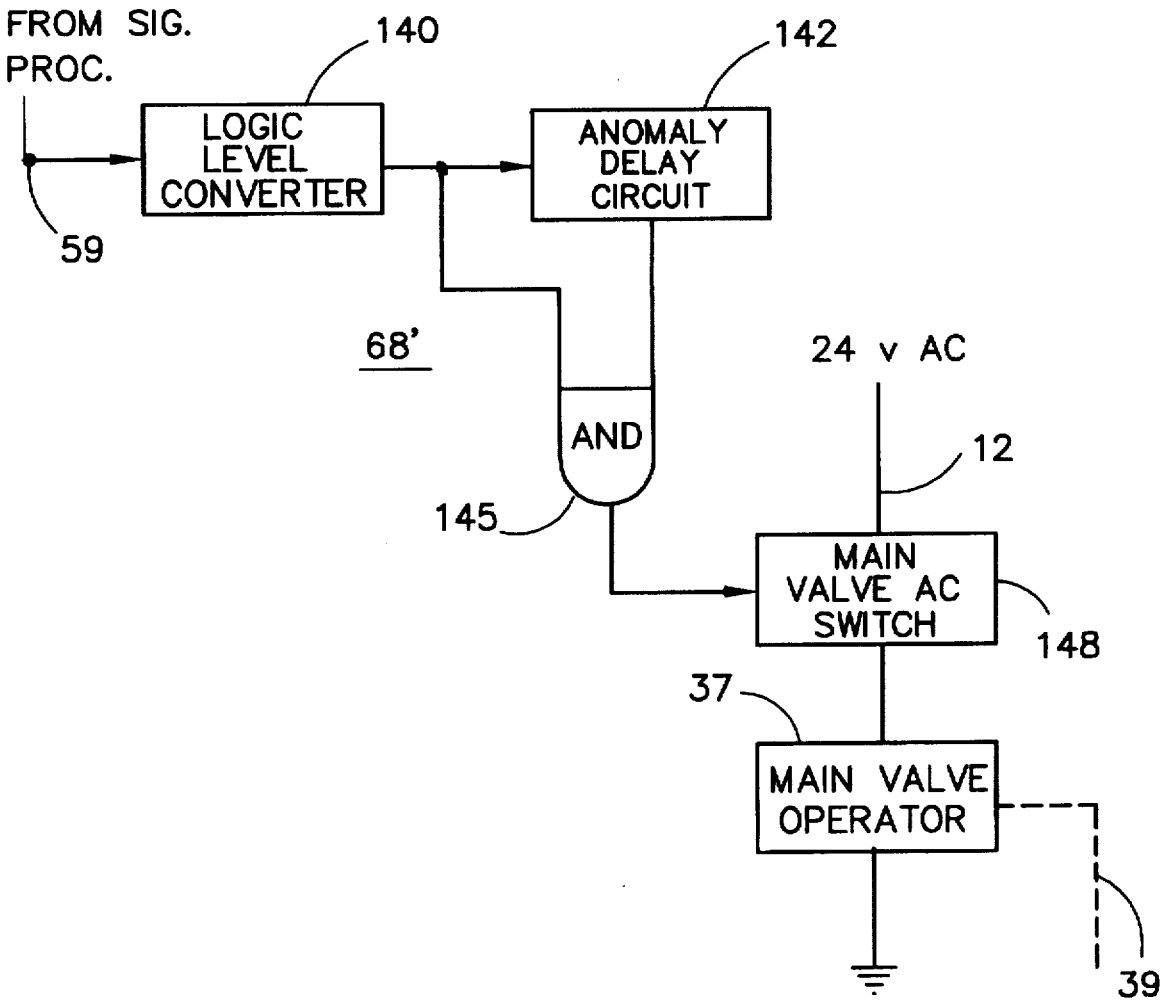
FIG. 4 is a variation of a portion of the block diagram of FIG. 1, in which logic circuits implement the invention.

The circuit of FIG. 4 discloses an alternative embodiment using logic circuit elements to provide the anomaly delay function for a main valve control circuit 68' which is entirely analogous to circuit 68 of FIG. 1. The control circuit 68' receives the flame indicator signal from a signal processor 58 identical to that shown in FIG. 1, as implied by the output terminal 59 shown in FIG. 4. Since the flame indicator signal from signal processor 58 does not have a voltage level compatible with typical logic circuits, a logic level converter 140 first transforms the flame indicator signal provided at terminal 59 to a format compatible with logic circuits. Without loss of generality, consider a first voltage level from converter 140 to represent a logical zero, and to arise from the flame indicator signal level on path 59 which indicates the absence of flame, and a second voltage level to represent a logical one level and to arise from a flame indicator signal level on path 59 which indicates the presence of flame.

The output signal from converter 140 is supplied to the input of an anomaly delay circuit 142 and to a first input of an AND gate 145. Delay circuit 142 may comprise a one-shot or other circuit providing a logic level output signal which normally has a logical one level. Delay circuit 142 has a transition from a logical one to a logical zero responsive to an opposite transition (logical zero to logical one) in the input signal which converter 140 provides. Delay circuit 142 maintains a logical zero output signal level for a predetermined interval after each logical zero to logical one transition at its input terminal. This predetermined interval is chosen to equal the appropriate anomaly delay interval. The output signal for delay circuit 142 is provided to a second input of AND gate 145. The output of AND gate 145 is applied to the control input terminal of a main valve AC switch 148. Switch 148 controls flow of AC power from power terminal 12 to the main valve operator 37, whose connection to the burner control is the same as is shown in FIG. 1. The mechanical linkage 39 to valve 38 is entirely similar to that shown in FIG. 1.

In operation, one will note that a transition from logical zero to logical one at the output of converter 140 occurs each time the flame rod signal on path 56 (FIG. 1) crosses the threshold voltage in the positive direction. Each such transition will cause the output signal from the delay circuit 142 to change from a logical one to a logical zero and continue at a logical one value for the anomaly delay interval. If the delay circuit 142 output signal is already at a logical zero signal level then the logical zero level is maintained for the anomaly delay interval.

When the flame rod signal crosses the threshold value and the output of the converter 140 becomes a logical one, one of the inputs of AND gate 145 is satisfied. At the same time the output signal from delay circuit 142 changes from a logical one to a logical zero and continues at the logical zero level for the anomaly delay interval. At the end of the anomaly delay interval the output signal from delay circuit 142 changes from a logical zero to a logical one, satisfying the second input of AND gate 145. The output signal of AND gate 145 then becomes a logical one causing switch 148 to close and power to flow to main valve operator 37, opening main valve 38. If for some reason the flame indicator signal should fall below the threshold level, the output signal level of converter 140 falls to a logical zero. The input signal to switch 148 falls to a logical zero and switch 148 opens, causing valve operator 37 to close main valve 38. It can be seen that if flame is lost, main valve 38 immediately closes.

There is yet another embodiment which employs a microprocessor to provide the anomaly delay function. A person of ordinary skill in the electrical arts is by now familiar with the operation of microcontrollers, and understands that for all practical purposes, each and every hardware circuit element has an analogous software embodiment by which the identical function may be performed by executing the appropriate instructions in the microprocessor.

This situation now makes it not only feasible to implement many electronic functions as software which controls a microprocessor, but in many cases the more cost effective approach as well for a variety of reasons.

It is important to understand that an invention whose preferred embodiment comes into being by programming a microprocessor or other type of computer rather than by connecting a number of discrete components, still in fact ultimately operates within that computer which is itself a discrete hardware circuit having a physical existence. In point of fact, in such a properly programmed microprocessor the individual hardware components necessary for physical existence of the invention do exist for brief periods of time within or as the microprocessor while the microprocessor is executing the instructions which implement the invention. Therefore, in a very real sense all inventions initially implemented as software ultimately achieve physical existence by virtue of the execution of the software within the computer.

It should be noted that even the individual software instructions have physical existence within the memory device in which they are stored for retrieval as needed by the microprocessor. For example, if these instructions are stored in a ROM, there are actual physical features in which the instruction data is recorded. Similarly, if the instructions are stored in a magnetic medium, there are magnetic characteristics in the medium surface which actually record the instruction data, and these characteristics themselves have physical existence.

Figure 5:
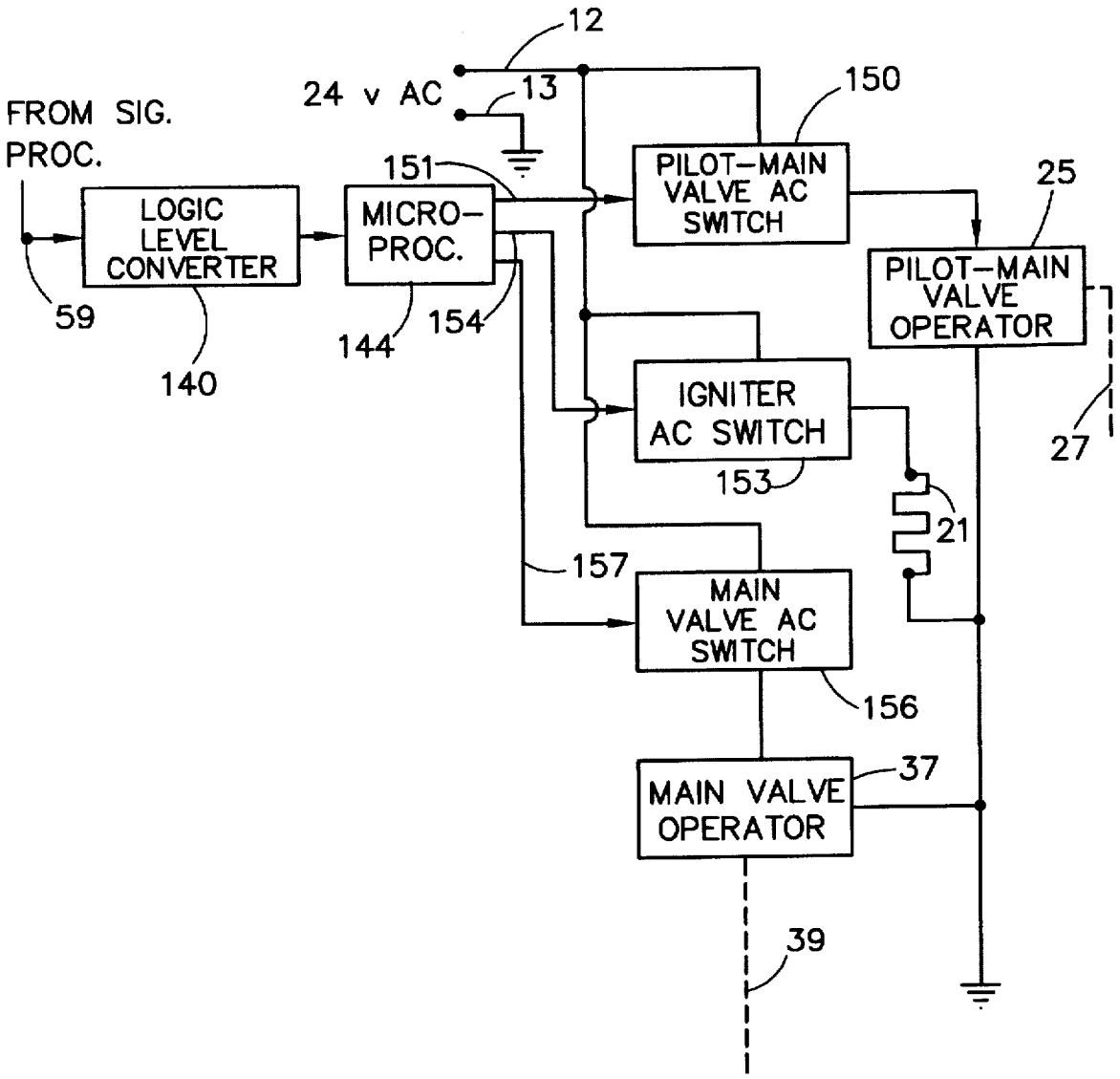
FIG. 5 is a block diagram of a burner system controller implementing the invention, and which is based on a microprocessor.

These insights are important in understanding FIGS. 5 and 6 and the relationship between them. FIG. 5 shows a burner system having a microprocessor 144 which provides the functions of both the sequencer 15 and the main valve control circuit 68 of FIG. 1. Whenever 24v. AC power is applied to path 12, microprocessor 144 receives power from power supply 18 (FIG. 1) and in response executes a control program which includes instructions for duplicating both the functions of sequencer 15 and of main valve control circuit 68. Microprocessor 144 receives the flame indicator signal on path 59 from signal processor 58. A logic level converter 140 identical to that of FIG. 4 converts the voltage level and shape of the flame indicator signal to a logic signal. The logic level converter 140 provides a logic level flame indicator signal to an input port of microprocessor 144.

Microprocessor 144 includes a number of output ports which provide the control signals for the various operating components of burner system 10. Each of these components are shown as including a switch which has a control terminal receiving a control signal from microprocessor 144. Thus a pilot-main valve AC switch 150 opens and closes responsive to the state of a control signal supplied on output port 151 by microprocessor 144, thereby controlling flow of power on path 12 to the pilot-main valve operator 25. The operation of igniter AC switch 153 to control igniter 21 and of main valve AC switch 156 to control main valve operator 37 is similar, with microprocessor providing control signals on paths 154 and 157 respectively to close the associated switches.

The flowchart of FIG. 6 defines software for controlling the operation of microprocessor 144 so as to provide functions similar to those which sequencer 15 and main valve control 68 of FIG. 1 provide. Each of the flowchart elements shown in FIG. 6 represent a set of instructions to be executed by the microprocessor 144. Rectangular elements such as element 163 are activity elements, and represent instructions whose execution cause the function specified within the element to be performed by microprocessor 144. Hexagonal elements such as element 174 are decision elements. Each set of software instructions have a normal sequence in which the instructions are executed. This is indicated in FIG. 6 by the direction of the arrows on the flow lines connecting the various elements. A decision element represents instructions which can interrupt that normal order of execution depending on the state of an internally available data value. Each decision element indicates with exiting "YES" and "NO" flow lines, at what element instruction execution will continue. Which of the flow lines is selected depends on the result of the test stated within the decision element whose instructions are being executed. Connector elements as at 160 represent positions in the sequence of instructions. Executing the instructions which an activity or decision element represents in essence transforms microprocessor 144 into a physical device for performing that function while the related set of instructions are being executed.

Instruction execution by microprocessor 144 to implement the invention starts in the flowchart of FIG. 6 with the instruction sequence indicated by connector element A 160, at activity element 163. Activity element 163 represents software instructions which cause microprocessor 144 to provide a signal on output port 154 to close the igniter AC switch 153 and provide power to igniter 21. Next, by executing instructions represented by activity element 167 causes the microprocessor 144 to place a signal on output port 151 and pilot-main valve AC switch 150 to close. AC power flows to operator 25 opening pilot-main valve 26 and allowing fuel to flow to pipes 32 and 33. Fuel flows to pilot burner 31 where the igniter 21 ignites the fuel.

Instruction execution proceeds to the connector element 170 which defines the start of the instructions which decision element 174 represents. The decision element 174 instructions test the logic level flame indicator signal provided by converter 140. If the flame indicator signal is present then decision element 174 continues instruction execution with activity element 176. If the flame indicator signal does not indicate that pilot flame is present, then execution returns to the instruction sequence marked by connector element 170.

Microprocessor 144 continues with instruction execution for activity element 176 once presence of the pilot flame is detected. Element 176 causes further instruction execution to halt for the anomaly delay interval. This is the same delay length which delay circuit 60 provides in the main valve control circuit of FIG. 1. Typical microprocessors have instructions which by accessing a timer circuit, can be used to delay further execution in the instruction sequence for a preselected time.

After the anomaly delay time provided by element 176, the instructions which decision element 183 represents are executed. These instructions may be identical to those of element 174, and again cause microprocessor 144 to test the input port at which is received the logic level flame indicator signal. If flame is not present, then execution returns to reexecute the same set of instructions which element 183 represents, as the "NO" flow line to connector 178 symbolizes. If flame is present, the "YES" flow line shows that instruction execution continues with the instructions which activity element 185 symbolizes. These instructions cause a signal to come up on output port 157 causing main valve AC switch to close, allowing power to flow to main valve operator 37, and main valve 38 opens. Fuel flows to main burner 42 and normal running commences.

Instruction execution then proceeds to other necessary operating functions, most important among them periodic testing of the pilot flame indicator signal. If the pilot flame indicator signal value changes to indicate absence of flame, then instructions which are periodically executed (say, every 100 ms.) sense this new value of the flame indicator signal and cause main valve 38 to immediately close and power to flow to igniter 21.

The embodiment of an invention in which an exclusive property or right is claimed are defined as follows:

1. In a burner controller for controlling the operation of a burner system having a pilot burner element and a pilot fuel valve opening responsive to a pilot valve signal to provide flow of fuel to the pilot burner element; a main burner element and a main fuel valve opening responsive to a main valve signal to provide flow of fuel to the main burner element; a flame rod type of flame sensor providing a flame rod signal having a level above a predetermined flame present level during normal operation responsive to combustion of fuel flowing to a burner element, said flame sensor on occasion upon initiation of flame providing for a first anomaly interval a flame rod signal having a level above the flame present level, thereafter providing for a second anomaly interval a flame rod signal having a level below the flame present level while flame is present, and thereafter providing a flame rod signal having a level above the flame present level; and valve control means receiving the flame rod signal for supplying the main valve signal responsive to the flame rod signal having current flow above the predetermined level, wherein the improvement comprises in the valve control means, a level sensor receiving the flame rod signal and providing a flame indicator signal having a first level substantially while the flame rod signal exceeds the flame present level and a second level otherwise, and main valve control circuit means receiving the flame indicator signal, for detecting the end of the second anomaly interval, and for providing a main valve signal thereafter.

2. The burner controller of claim 1, wherein the main valve control circuit means comprises a delay element receiving the flame indicator signal and providing a delayed flame indicator signal in which each second level to first level transition of the flame indicator signal is delayed for a preselected delay interval longer than most of the first anomaly intervals, and logic means receiving the flame indicator signal and the delayed flame indicator signal, for providing the main valve signal responsive to both the flame indicator signal and the delayed flame indicator signal having their first levels.

3. The burner controller of claim 2, wherein the preselected delay interval of the delay element is no more than 2 seconds.

4. The burner controller of claim 2, wherein the delay element further comprises a one-shot receiving the flame indicator signal and providing a delayed flame indicator signal having a second level for the predetermined delay interval beginning with a second level to first level transition of the flame indicator signal and a first level otherwise, and wherein the logic means comprises an AND gate receiving the flame indicator signal and the delayed flame indicator signal, and providing the main valve signal responsive to simultaneous presence of the first level in both the flame indicator signal and the delayed flame indicator signal.

5. The burner controller of claim 4, wherein the one-shot has a time constant of greater than 1 second.

6. The burner controller of claim 2, wherein the delay element and the logic means both comprise a microcontroller receiving the flame indicator signal, and having a memory in which is recorded a plurality of instructions and an instruction processor receiving instructions from the instruction processor, said memory and instruction processor in combination comprising first through fourth instruction means respectively existing during execution of first through fourth groups of instructions, wherein the logic means comprises the first and second instruction means, and wherein the delay element comprises the third instruction means, said first and second instruction means respectively transferring instruction execution to the third and fourth groups of instructions responsive to a transition from the second to the first level in the flame indicator signal; wherein said third instruction means transfers execution of instructions to the second group of instructions after delaying for the preselected delay interval; and wherein said fourth instruction means includes means for causing the instruction processor to issue the main valve signal to the main valve.

7. The controller of claim 6, wherein the first instruction means comprises means for transferring instruction execution to the first of the instructions in the memory comprising the first instruction means responsive to the second level of the flame indicator signal.

8. The controller of claim 6, wherein the second instruction means comprises means for transferring instruction execution to the first of the instructions in the memory comprising the second instruction means responsive to the second level of the flame indicator signal.

9. The burner controller of claim 1, wherein the main valve control circuit means comprises a) a delay element receiving the flame indicator signal at an input terminal and supplying a flame indicator signal delayed by a preselected amount of time at an output terminal; and b) first and second switches, each switch having first and second power terminals and a control terminal, said first and second switches electrically connecting their first power terminals to their respective second power terminals responsive to a connect signal at the associated control terminal, said first and second switches' power terminals in series connection to supply operating power to the main valve, and wherein the first switch receives the first level of the flame indicator signal at its control terminal as the connect signal thereat, and the second switch receives the delayed flame indicator signal at its control terminal as the connect signal thereat.

10. The burner controller of claim 9, wherein the delay element delays the flame indicator signal by an amount of time greater than the typical duration of the first anomaly interval.

11. The burner controller of claim 9, wherein the first and second switches' power terminals are in series connection.

12. The burner controller of claim 11, wherein the delay element delays the flame indicator signal by an amount of time greater than the typical duration of the first anomaly interval.

13. The burner controller of claim 9 for connection to a source of electrical power responsive to a demand for burner operation, and including a power supply receiving electrical power from the source and supplying an operating voltage between first and second power supply terminals for powering elements of the burner controller, wherein the delay element further comprises:

a) a capacitor having a second terminal connected to the second power supply terminal and a first terminal electrically connected to the second switch control terminal, to control the conduction state of the second switch; and b) a capacitor charge control circuit receiving the flame rod signal, and connecting the power supply to charge the capacitor responsive to the flame present level exceeding the flame rod signal level and to discharge the capacitor responsive to the flame rod signal level exceeding the flame present level, and wherein the second switch opens responsive to the capacitor voltage exceeding a preselected threshold level and closes responsive to the threshold level exceeding the capacitor voltage.

14. The burner controller of claim 13, wherein the capacitor charge control circuit comprises a) a first resistor connecting the capacitor's first terminal to the power supply's first terminal; and b) a transistor having power terminals connected across the capacitor terminals and receiving the flame rod signal at a control terminal, said transistor, responsive to the flame rod signal exceeding the flame present level, conducting between its power terminals and discharging the capacitor, and said transistor, responsive to the flame present level exceeding the flame rod signal, allowing the power supply to charge the transistor through the first resistor.

15. The burner controller of claim 14, wherein the capacitor charge control circuit further comprises a second resistor in series connection with the first resistor at a common resistor terminal to form a series resistor circuit, said series resistor circuit connecting the capacitor first terminal to the power supply first terminal; wherein the transistor power terminals are connected between the common resistor terminal and the first switch's control terminal; and wherein the first switch closes responsive to connection between the control terminal thereof and the common resistor terminal.

* * * * *